US006206027B1

(12) United States Patent
Ponnet et al.

(10) Patent No.: US 6,206,027 B1
(45) Date of Patent: Mar. 27, 2001

(54) TANK FOR PRESSURIZED FLUID, IN PARTICULAR FOR LIQUEFIED GAS

(75) Inventors: Lionel Ponnet, Bordeaux; Patrick Jacquier, Lyons; Jean-Louis Charles, Kourou, all of (FR)

(73) Assignee: Societe Nationale d'Etude et de Construction de Moteurs d'Aviation - S.N.E.C.M.A., Paris (FR)

( * ) Notice: Subject to any disclaimer, the term of this patent is extended or adjusted under 35 U.S.C. 154(b) by 0 days.

(21) Appl. No.: 09/319,651

(22) Filed: Jun. 10, 1999

(30) Foreign Application Priority Data

Dec. 13, 1996 (FR) ..... 96 15337

(51) Int. Cl.[7] ..... F17C 1/00
(52) U.S. Cl. ..... 137/266; 137/256
(58) Field of Search ..... 137/266, 255, 137/259, 256

(56) References Cited

U.S. PATENT DOCUMENTS 3,575,195 * 4/1971 Alfieri ..... 137/266

FOREIGN PATENT DOCUMENTS 15 29 102 12/1969 (DE) .
783 241 7/1935 (FR) .
2 159 263 11/1985 (GB) .

* cited by examiner

*Primary Examiner*—Kevin Lee
(74) *Attorney, Agent, or Firm*—Weingarten, Schurgin, Gagnebin & Hayes LLP

(57) ABSTRACT

The tank is made up of a plurality of elementary tanks such as tubes (20) connected in parallel to at least one manifold device (30, 32), and it includes closure valves enabling any one of the elementary tanks to be isolated in response to a drop in the pressure contained therein.

10 Claims, 3 Drawing Sheets

TANK FOR PRESSURIZED FLUID, IN PARTICULAR FOR LIQUEFIED GAS

FIELD OF THE INVENTION

The present invention relates to a tank for fluid under pressure, more particularly a fluid under high pressure, i.e. much greater than 1 MPa, typically greater than 5 MPa.

A particular, although not exclusive, field of application of the invention is that of tanks for liquefied gas, in particular for liquefied propane gas (LPG) used in motor vehicles.

BACKGROUND OF THE INVENTION

The presence of tanks under pressure close to people or sensitive goods, or in a confined space, gives rise to problems of safety. The usual solution consists in using a container that is strong, and thus heavy. In addition, the optimum shape for such a container enabling it to withstand internal pressure well often limits the ways in which it can be installed, in particular on a motor vehicle. This takes up a large amount of the available volume in the vehicle. In addition, safety standards mean that vehicles fitted with such tanks can be banned from having access to road tunnels.

BRIEF DESCRIPTION OF THE INVENTION

An object of the invention is to provide a tank for fluid under high pressure that does not present those drawbacks, and to this end the invention provides a tank comprising a plurality of elementary tanks connected in parallel to at least one manifold device, and closure means suitable for isolating any one of the elementary tanks in response to the pressure therein dropping.

Advantageously, the elementary tanks are constituted by tubes.

A first advantage of the invention lies in the great ease with which it can be adapted to the space available. Ability to withstand pressure is determined by the section and the wall thickness of each elementary tank, regardless of the overall shape of the tank as a whole. It is therefore possible to distribute the volume of the tank in the space available while using elementary tanks of different lengths or by placing them in rows with varying numbers per row, or grouping them together in distinct subassemblies which are interconnected. This option is particularly advantageous for motor vehicles to ensure that the housing for the tank does not penalize available volume.

In addition, because of its modular design, the tank is simple to make and of low cost. This applies in particular with elementary tanks that are in the form of tubes since the same tubes, when cut to desired lengths, can be used to make tanks of any shape and of any volume.

Furthermore, such elementary tanks present the ability to contain external pressure, typically due to a relative loss of pressure in the elementary tank, that would not be possible with a container of any complex shape without special architecture and dimensioning.

The present invention also makes it possible to use various materials for the elementary tanks, for example metals, metal alloys, or composite materials. Composite materials can be reinforced with carbon fibers, "Kevlar" (registered trademark) or glass, and they can have a matrix made of resin, e.g. epoxy resin.

In addition, the requisite conditions, particularly in terms of wall thickness, are much less severe for each elementary tank than they are for a single-body tank having the volume of the tank that is to be provided, and the mass saving compared with a single body tank can be significant.

Another advantage of the tank of the invention is safety. Because of the closure means, damage to an elementary tank does not endanger the entire tank together with its content, and thus limits nuisance to the environment in the event of a leak. The low rate of flow and the small total volume of fluid that escapes when only one elementary tank is damaged mean that certain restrictions on use, such as banning access to road tunnels, for example, need no longer be justified.

Advantageously, the closure means are in the form of respective valves, for example in the form of flexible membrane means, which are mounted at each end of each elementary tank that is connected to a manifold, a valve closing the end of an elementary tank in response to the pressure in said elementary tank dropping relative to the pressure in the manifold. A same flexible membrane can be mounted in a manifold connected to a plurality of elementary tank ends so as to be common to a plurality of elementary tanks.

The tank can be provided with a protective shield covering at least each exposed surface of the tank.

The shield advantageously has an armored structure made up of a rigid covering sheet and a thick underlying layer of cellular material in foam or honeycomb form. The covering sheet, e.g. of composite material, is capable of absorbing part of the energy of an impact or of a projectile, and of transmitting the energy it does not absorb to the foam material which is suitable for spreading it over a large area of the tank so as to avoid deforming the underlying structures. The magnitude of the impacts that are to be absorbed without functionally damaging the tank overall will determine the dimensioning of the shield.

BRIEF DESCRIPTION OF THE DRAWINGS

Other features and advantages for the tank of the invention will appear on reading the following description given below by way of non-limiting indication with reference to the accompanying drawings, in which.

DETAILED DESCRIPTION OF PREFERRED EMBODIMENTS

The description below relates to making a tank for liquefied gas under high pressure, and more particularly an LPG tank for a motor vehicle. The person skilled in the art will understand that the principles described are immediately applicable to other uses of tanks for gas or liquid under pressure, for example tanks containing toxic substances on industrial sites or tanks containing halon gases.

Figure 1:
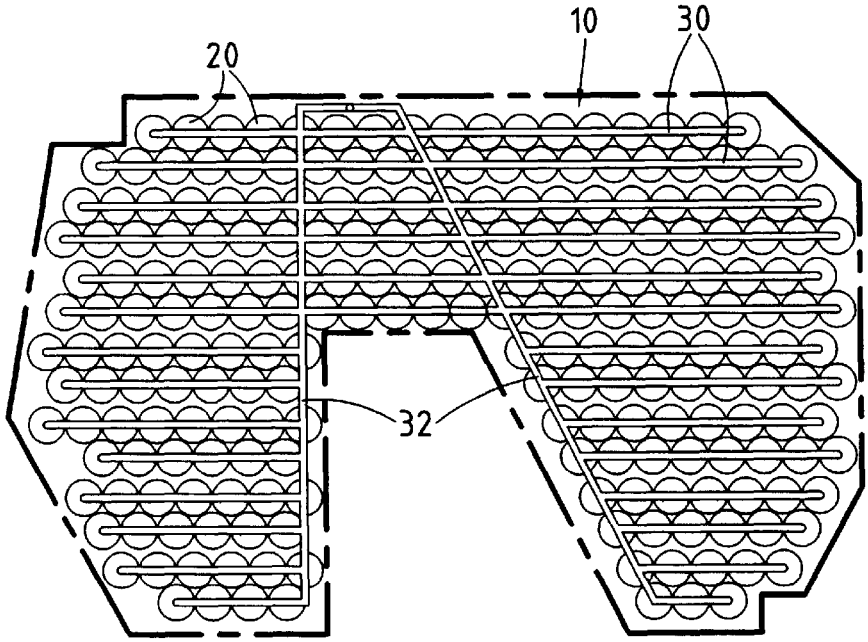
FIGS. 1 and 2 are highly diagrammatic views, respectively an end view and a side view, showing an embodiment of a tank of the invention.
Figure 2:
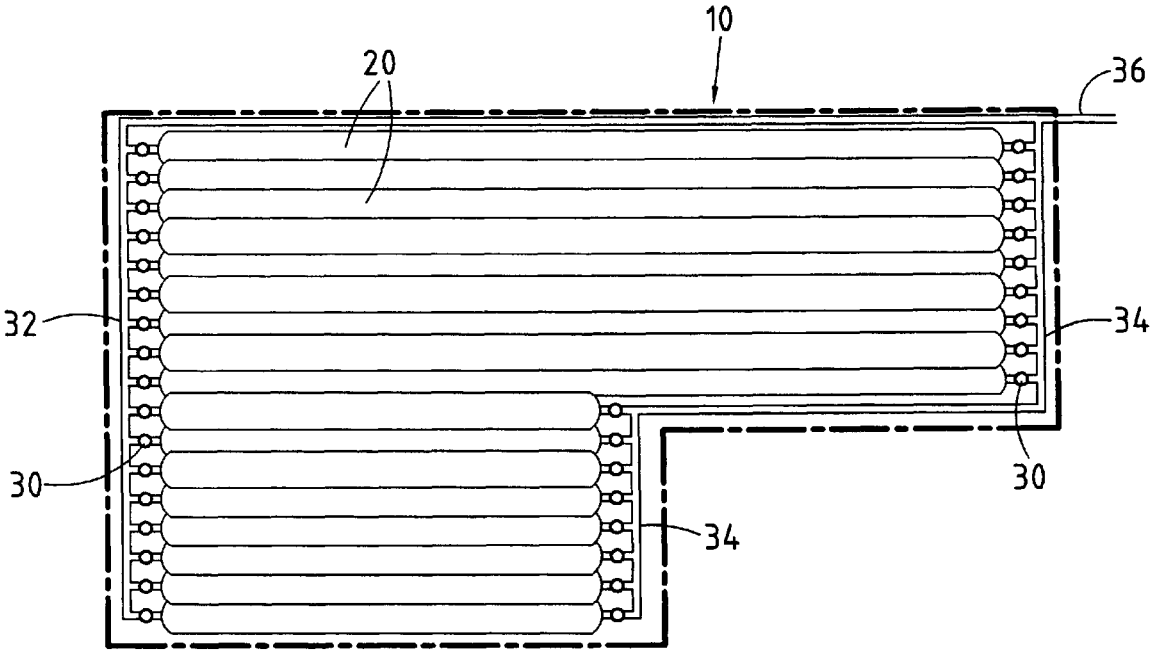

FIGS. 1 and 2 show a tank 10 made up of a plurality of elementary tubes 20 connected in parallel to manifolds 30.

The tubes 20 are disposed parallel to one another in a plurality of superposed rows, i.e. in a "bundle" type of disposition. The tubes all have the same diameter and the same wall thickness. By way of example they are made of metal, such as steel, or of a composite material, such as epoxy resin reinforced with fibers of carbon or "Kevlar" (registered trademark).

The lengths of the tubes 20 and the numbers of the tubes in each of the rows are selected so as to occupy in optimum manner the volume available for housing the tank, e.g. beneath the structure of a vehicle. In FIGS. 1 and 2, the limits on the available volume are represented by chain-dotted lines. As can be seen immediately, building up a tank in modular form using elementary tubes is particularly well suited to adapting the tank to a variety of shapes.

At each of its two ends, each tube 20 is connected to a manifold 30. In the example shown, each manifold 30 is in the form of a tube to which the elementary tubes 20 in a given row of tubes are all connected. Additional manifolds 32 and 34 interconnect the manifolds 30 in parallel at each of the two ends of the tank. The manifolds 32 and 34 are connected to a duct 36 connecting the tank 10 to an outlet for use and to an inlet for filling (not shown).

Figure 3:
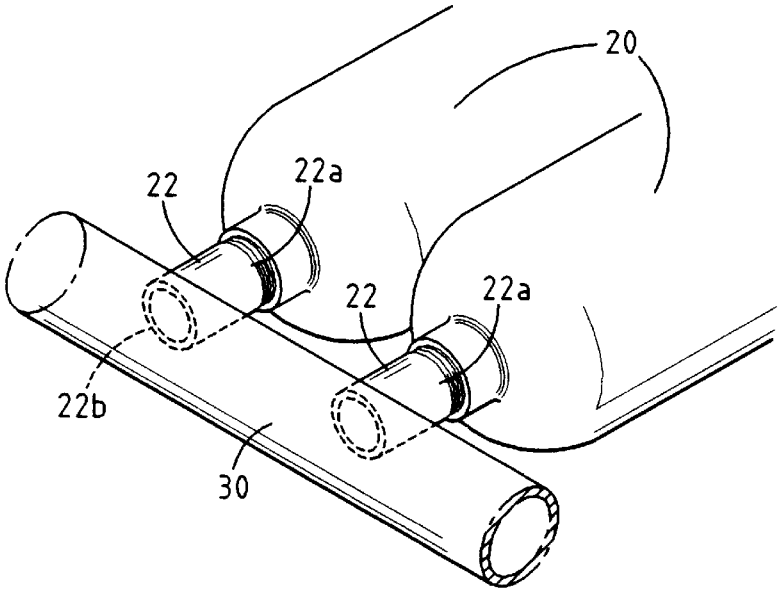
FIG. 3 is a detail view showing how an elementary tube is connected to a manifold in the tank of FIGS. 1 and 2.

Each end of an elementary tank 20 is connected to a manifold 30 by means of a coupling 22 which is screwed or welded to an end 22*a* of the elementary tank 20 and which is screwed or welded at its opposite end to the manifold tube 30. The coupling 22 penetrates a short distance into the manifold tube 30 at its opposite end 22*b*, so that this end projects inside the tube (FIGS. 3, 4, and 5).

Although an array of manifolds is described at each end of the elementary tubes, it is naturally possible to provide only one array of manifolds at one end of the tube, in which case the opposite ends are closed.

In addition, instead of using manifolds 30 in the form of tubes themselves interconnected in parallel to manifold tubes 32 or 34, each manifold assembly at each end of the tank could be constituted by a sinuous tube passing along all of the rows of tubes, or it could be constituted by a hollow end plate. In which case the end plate would be formed by two spaced-apart parallel walls interconnected in gastight manner around their periphery, with one of the walls being provided with holes into which the couplings of the elementary tubes penetrate.

Figure 4:
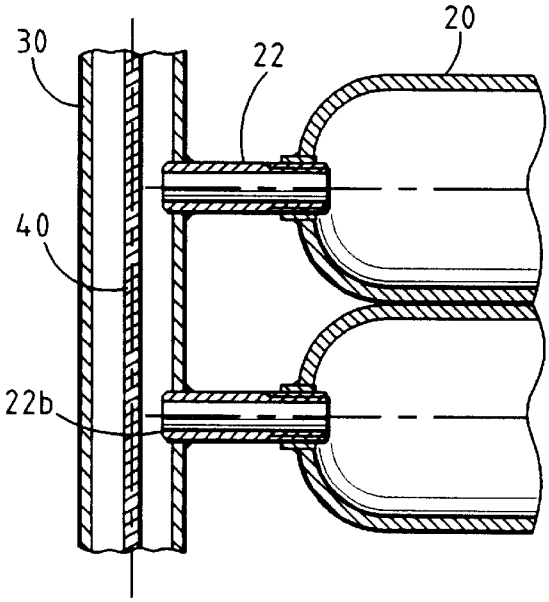
FIGS. 4 and 5 are highly diagrammatic section views showing means for closing elementary tubes in the tank of FIGS. 1 and 2.
Figure 5:
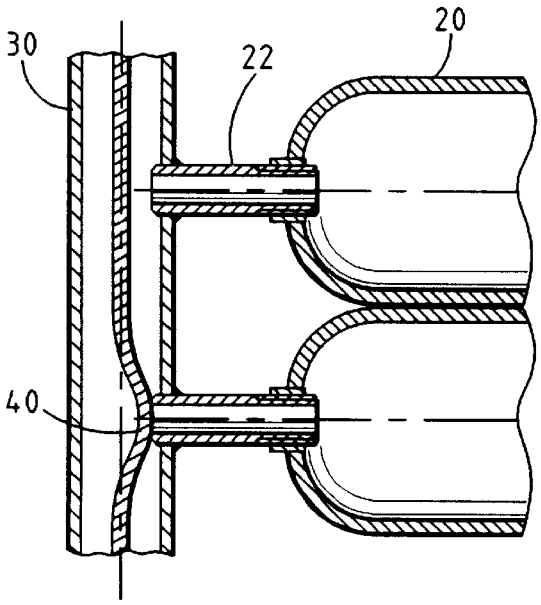

FIGS. 4 and 5 show a flexible membrane 40 constituting closure means for the elementary tubes 20 in the event of the pressure within any elementary tube dropping, e.g. because of a break or damage resulting from a collision or the impact of a projectile.

In the example shown, the membrane 40 is in the form of a strip of flexible material extending along the entire length of the manifold 30 with its faces perpendicular to the axes of the elementary tubes 20 of the row associated with the manifold. As a result, the membrane 40 constitutes closure means that are shared by all of the tubes 20 in the row. At its ends, the membrane 40 is fixed to the closed ends of the manifold 30, e.g. by adhesive or by mechanical means.

By way of example the flexible membrane 40 is made of a composite material constituted by a fiber-reinforced elastomer. In normal operation, the membrane 40 is not deformed and allows free access to the tubes 20 that are connected to the manifold tube 30 (FIG. 4). Equal pressures are maintained on both faces of the membrane since it does not split the manifold 30 into two longitudinal volumes that are isolated from each other in sealed manner.

In the event of a sudden pressure drop in an elementary tube 20 (FIG. 5), the membrane 40 automatically deforms and closes the end 22*a* of the coupling 22 corresponding to said tube. The same phenomenon occurs at both ends of the elementary tube if it is connected to a manifold assembly at each of its ends. As a result, the faulty portion of the tank is rapidly isolated from the remainder of the tank, which remainder can continue to be used, with any losses of fluid being very limited.

The use of a flexible membrane is advantageous because of its low cost and its reliability, given that no moving parts are required. Nevertheless, other embodiments of the closure means could be used, for example non-return valves associated with each end of each elementary tube, with the non-return valves then being optionally subjected to a small return force that keeps them open in the event of no pressure drop in the corresponding elementary tubes.

As already mentioned, the use of elementary tubes, each of which can be quite small in diameter, typically less than 5 cm, or even less than 1 cm, makes it possible to withstand pressures that are very high while using walls that are not very thick. For example, tubes made of carbon/epoxy composite material having an outside diameter of 8 mm and a wall thickness of 1 mm can withstand an internal pressure of 100 MPa.

A tank, even for a fluid under high pressure, can thus be substantially lighter than a single-body tank of the same capacity.

In order to protect the elementary tubes against impact and against projectiles, it is desirable to provide the tank with a protective shield, at least over each exposed face.

Figure 6:
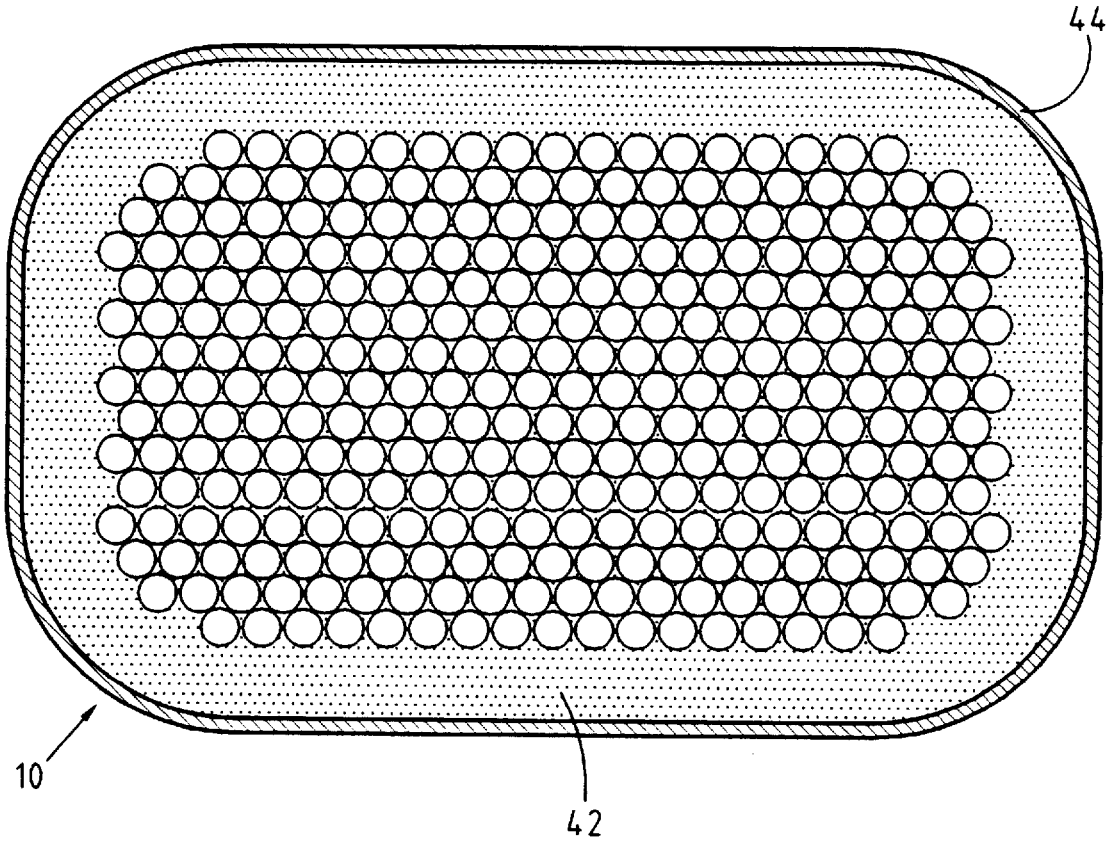
FIG. 6 is a section view through a tank of the invention which is fitted with a shield for protecting it against impacts and projectiles.

Such a shield is shown in FIG. 6. In this example, it comprises a layer of foam material 42, in particular polyurethane foam, surrounding the bundle of elementary tubes 20 and the manifold tubes. The layer 42 is coated by a rigid shell or structure 44, e.g. made of a composite comprising an epoxy resin matrix reinforced with aramid fibers. The shell 44 can be formed by draping resin-impregnated fiber fabric over the foam 42 and then polymerizing the resin. In a variant, the impregnated fiber fabric can be draped over the inside face of a mold in which the tank is inserted for the purpose of forming the covering foam layer. The shield may also be constituted by a case of fibers, e.g. aramid fibers, and a thickness of honeycomb structure material taking the place of and performing the function of the foam material.

The use of a protective shield is particularly desirable when the elementary tubes (and the manifold tubes) are made of a material other than metal, for example a composite material, since such materials often present lower impact resistance and provide less plasticity than metals.

In the event of a collision or an impact, the rigid shell 44 distributes the pressure over the surface of the foam 42. This distributes the pressure even more, such that no deformation is imparted to the rear face of the foam which is in contact with the elementary tubes of the tank.

In the above, it is assumed that the tank 10 can be complex in shape while being implemented as a single set of elementary tubes 20.

Figure 7:
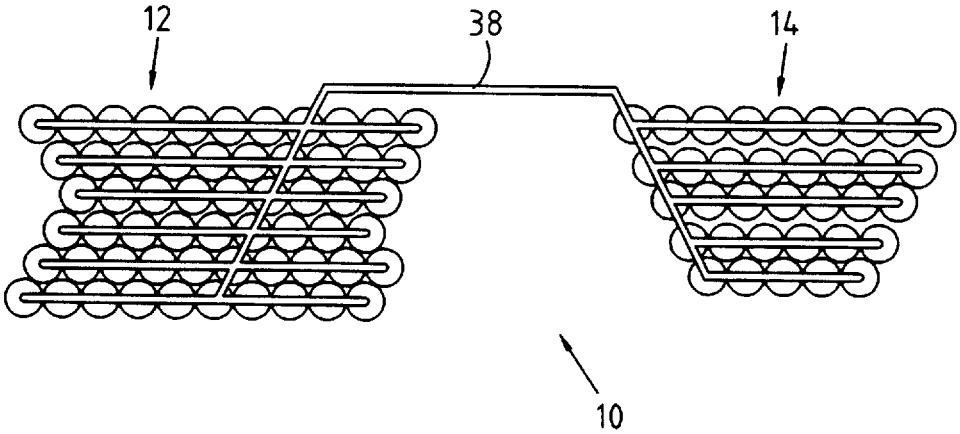
FIG. 7 is a highly diagrammatic view showing an embodiment of a tank of the invention in a plurality of portions.

When separate spaces are available for receiving the tank and none of them offers sufficient volume on its own, it is possible as shown in FIG. 7 to make the tank 10 as a plurality of subassemblies 12, 14. Each subassembly comprises a plurality of elementary tubes of lengths and dispositions which are selected as a function of the space available. The subassemblies 12, 14 are interconnected by one or more pipes 38.

What is claimed is:

1. A tank for a fluid under pressure, comprising:

a plurality of elementary tanks in the form of at least one bundle of adjacent tubes disposed parallel to one another, each tube having an end connected to a manifold device to which several tubes are connected in parallel, said manifold device being connected to an output of said tank; and closure means in the form of respective valves each mounted at said tube end, each valve being responsive to a pressure drop in the corresponding tube relative to the pressure in the manifold device to which said corresponding tube is connected, so as to close said tube end, thereby isolating said corresponding tube from the manifold device.

2. A tank as claimed in claim 1, wherein said bundle comprises a plurality of tubes disposed parallel to one another in a plurality of rows.

3. A tank as claimed in claim 2, wherein at least two of said rows of tubes have different numbers of tubes.

4. A tank as claimed in claim 1, wherein said bundle comprises tubes of at least two different lengths.

5. A tank as claimed in claim 1, comprising a plurality of interconnected subassemblies, each subassembly comprising a bundle of tubes disposed parallel to one another.

6. A tank as claimed in claim 1, wherein each of said valves includes a flexible membrane.

7. A tank as claimed in claim 6, wherein said flexible membrane is mounted in said manifold device and is common to said several tubes.

8. A tank as claimed in claim 1, further comprising a protective shield.

9. A tank as claimed in claim 8, wherein said protective shield comprises a layer of foam or honeycomb cellular material covered with a rigid shell of composite material.

10. A tank as claimed in claim 1, wherein said tubes are made of a composite material.

* * * * *

UNITED STATES PATENT AND TRADEMARK OFFICE

CERTIFICATE OF CORRECTION

PATENT NO. : 6,206,027 B1
DATED : March 27, 2001
INVENTOR(S) : Lionel Ponnet et al.

It is certified that error appears in the above-identified patent and that said Letters Patent is hereby corrected as shown below:

Title page,
Item [75], Inventors, “Lyons” should read -- Lyon --.

Signed and Sealed this

Twenty-second Day of October, 2002

*Attest:*

*Attesting Officer*

JAMES E. ROGAN
*Director of the United States Patent and Trademark Office*